United States Patent [19]

Baker

[11] 4,235,364

[45] Nov. 25, 1980

[54] MULTI-PURPOSE CONTAINER BLANK

[75] Inventor: Harold L. Baker, Longview, Wash.

[73] Assignee: Weyerhaeuser Company, Tacoma, Wash.

[21] Appl. No.: 59,853

[22] Filed: Jul. 23, 1979

[51] Int. Cl.[3] ..... B65D 5/22; B65D 5/20

[52] U.S. Cl. ..... 229/34 R; 229/16 R; 229/33

[58] Field of Search ..... 229/33, 34, 16 A, 16 R

[56] References Cited

U.S. PATENT DOCUMENTS

| | | | |
|---|---|---|---|
| 1,270,642 | 6/1918 | Martin, Jr. | 229/34 R |
| 2,037,839 | 4/1936 | Wagenseller | 229/33 |
| 2,077,694 | 4/1937 | Hinton | 229/33 |
| 2,988,259 | 6/1961 | Callinicos | 229/34 R |
| 3,251,532 | 5/1966 | Hechtman et al. | 229/33 |
| 3,371,842 | 3/1968 | Hechtman et al. | 229/33 |
| 3,598,303 | 8/1971 | Folz | 229/34 R |
| 4,136,817 | 1/1979 | Perry | 229/33 |

*Primary Examiner*—Davis T. Moorehead

[57] ABSTRACT

A pair of blanks are scored and perforated in a manner that allows them to be formed into a variety of different sized containers.

2 Claims, 14 Drawing Figures

35B'
28B'
25E'
35A'
34B'
25D'
30B'
28A'
26E'
25'
35C'
41B
34A'
28C'
38B
25H
26D'
31B'
38A
26'
25G
41A
30A'
34C'
40B
26H
30C'
27B'
37B
40A
32B'
29A'
37A
41C
25A'
39A
38C
31A'
40C
26G
27A'
37C
26A'
31C'
39C
29C'
32C'
27C'
35B'
34B'
35A'
41B
35C'
34A'
31B'
41A
40B
34C'
40A
41C
40C
39A
31A'
39C
32C'
26F
26B'
25H
25D'
41A
34A'
26H
26D'
35A'
41C
34C'
41B
35B'
34B'
25H
25D'
41A
26H
34A'
26D'
25E'
41C
35A'
34C'
26E'
35C'
39C

MULTI-PURPOSE CONTAINER BLANK

BACKGROUND OF THE INVENTION

1. Field of the Invention

Blanks for corrugated containers.

2. Description of the Prior Art

Perry, U.S. Pat. No. 4,136,817, discloses a container blank of complicated construction for forming a variety of containers. Fotz, U.S. Pat. No. 3,598,303, discloses a box form having spaced fold lines to provide an open box of various sizes and various heights with tabs provided on certain of the folding members to lock the carton in assembled position.

SUMMARY OF THE INVENTION

Many businesses, especially mail order houses, have a need for different sized containers for packaging different sized products. This has led to a problem of carrying an inventory of each of the different sized containers or blanks for these containers. The inventor decided that it would be possible to reduce the inventory by providing a pair of blanks which are scored and perforated in a manner that allows each blank to be formed into a number of different sized containers and the pair of blanks to be telescoped together to form other sized containers.

The spacing of the score lines is based on a first dimension A. Two transverse score lines are parallel to the transverse edges of the blank. Each is positioned inwardly from its adjacent transverse edge the first dimension A. The distance between the two transverse score lines is a second dimension B. This may be any distance.

In the basic design there are also four score lines running longitudinally of the blank between the transverse score lines. Each of these is parallel to the longitudinal edges of the blank. Each of the outer pair of longitudinal score lines is spaced from its adjacent longitudinal edge the first dimension A and each of the inner pair of longitudinal score lines is spaced inwardly of its adjacent outer longitudinal score lines the first dimension A. The distance between the two inner longitudinal score lines is twice the first dimension A.

There may be a third pair of longitudinal score lines. Each of these is spaced inwardly from the adjacent score line in the inner pair of score lines one-half the first dimension A and they are spaced from each other the first dimension A.

There are perforations extending between each longitudinal transverse score line and its adjacent transverse edge. The longitudinal perforations are aligned with each of the longitudinal score lines.

DESCRIPTION OF THE PREFERRED EMBODIMENT

Figure 1:
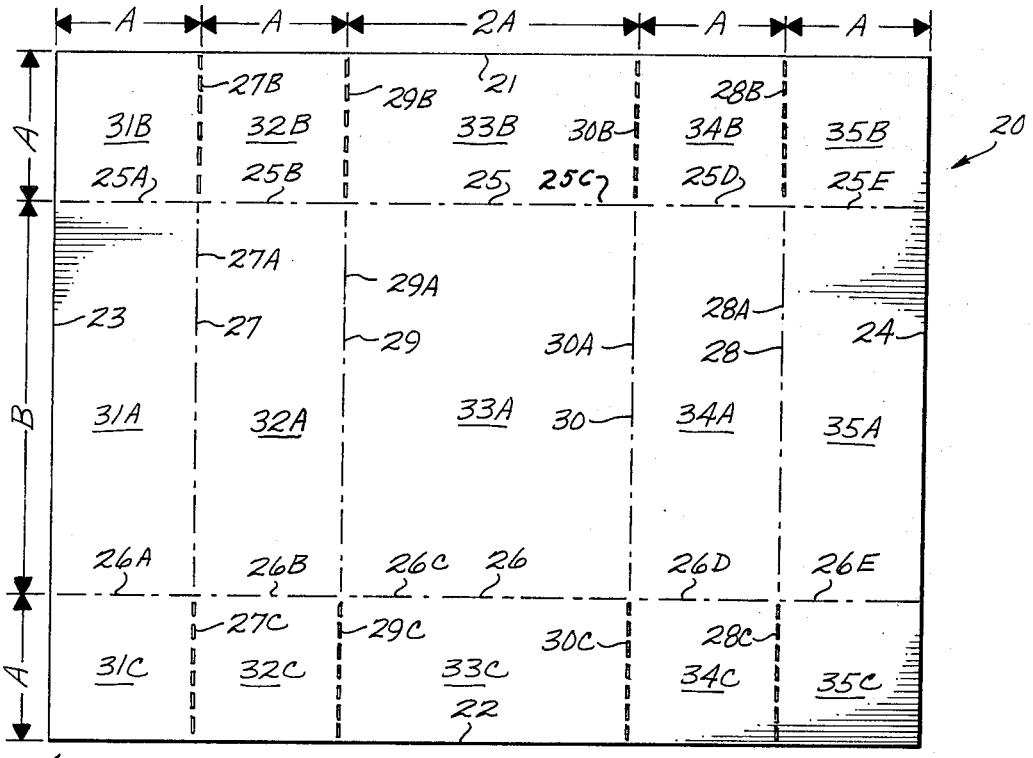
FIGS. 1 and 2 are top plan views of the two blanks, FIG. 1 representing the blank for the top container and FIG. 2 the blank for the bottom container. The latter blank also contains the pair of optional longitudinal score lines and perforations.
Figure 2:
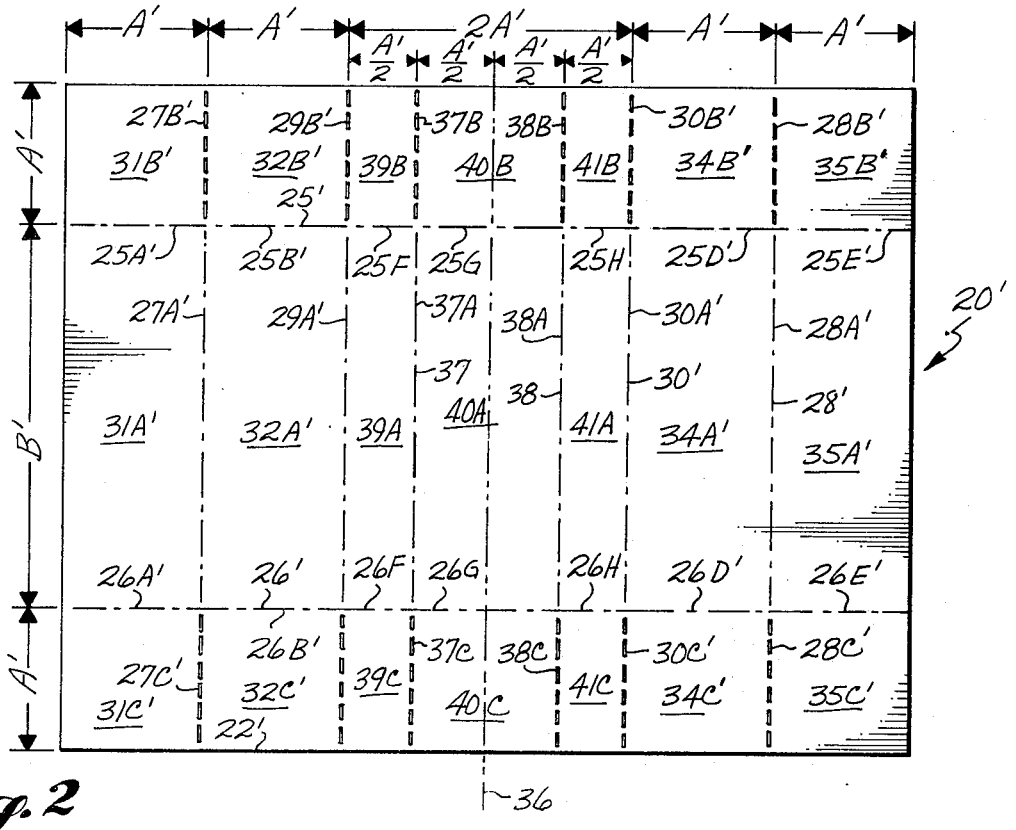
Figures 3, 4, 5, 6:
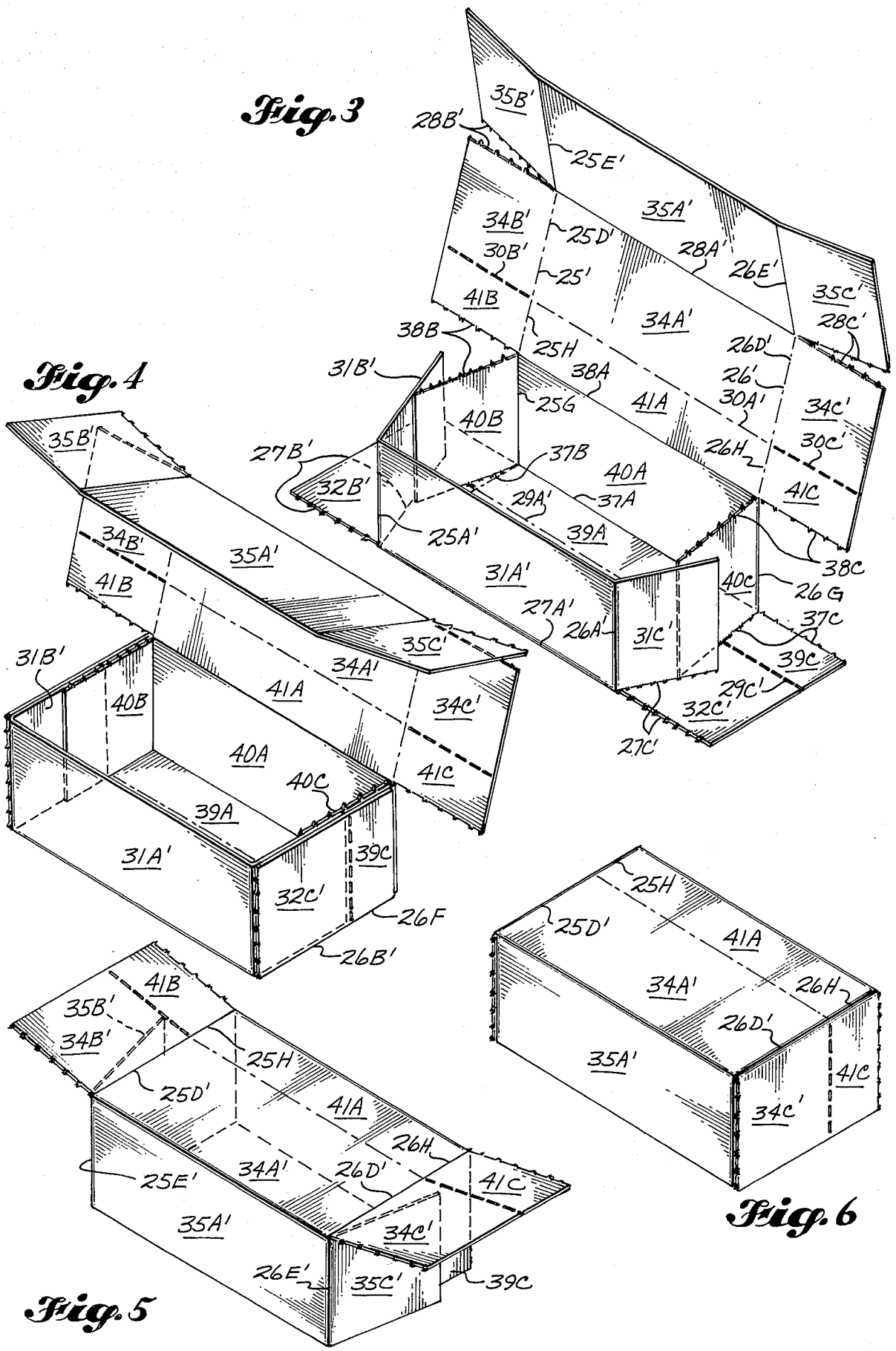
FIGS. 3–14 are isometric views of various containers that may be formed from the blanks of FIGS. 1 and 2.

FIGS. 1 and 2 show the two rectangular blanks which are useful for forming the various sized containers. The blank 20 in FIG. 1 is larger than blank 20' in FIG. 2. The blank 20 would be the blank for the top of a telescoping container and blank 20' would be the blank for the bottom of the telescoping container. The basic scores and perforations to form the various containers are on the blanks in FIGS. 1 and 2 and the additional optional scoring and perforations are on the blank in FIG. 2. The basic scoring and perforations for both FIGS. 1 and 2 will be described in conjunction with FIG. 1 and only the optional scoring and perforations will be described in conjunction with FIG. 2.

In FIG. 1 blank 20 has parallel transverse edges 21 and 22 and parallel longitudinal edges 23 and 24. As is customary in most container blanks, the longitudinal edges are perpendicular to the transverse edges. In this description the terms transverse and longitudinal are being used arbitrarily and are not necessarily related to the machine direction of the liner or the corrugations.

There are two transverse score lines 25 and 26 on blank 20. Each of these is parallel to the transverse edges 21 and 22 and each is spaced the first dimension A from its adjacent transverse edge, score line 25 being a distance A from edge 21 and score line 26 being a distance A from edge 22. The distance between score lines 25 and 26 is arbitrary and is indicated by a second dimension B.

The blank 20 is divided by a series of longitudinal lines that are parallel to the longitudinal edges 23 and 24. Each of the outer pair of longitudinal lines, 27 and 28, is spaced the first dimension A from its adjacent longitudinal edge, line 27 being a distance A from edge 23 and line 28 being a distance A from edge 24. Each of the inner pair of longitudinal lines, 29 and 30, is spaced the first dimension A from the adjacent scoreline in the outer pair of score lines, line 29 being a distance A from line 27 and line 30 being a distance A from line 28.

Each of these longitudinal lines is divided into a central section and two side sections by the transverse score lines 25 and 26. The portion of each of the longitudinal lines between the transverse score lines is scored and the portion of each of the longitudinal lines extending outwardly from the transverse score lines is perforated. For example, line 27 is divided by transverse score lines 25 and 26 into a central scored section 27A between the score lines and two outer perforated sections 27B and 27C which extend between a transverse score line and its adjacent outer edge, 27B extending between transverse score line 25 and outer edge 21 and perforated section 27C extending between transverse score line 26 and transverse edge 22. Each of the other longitudinal lines 28, 29 and 30 is divided similarly.

The longitudinal lines also divide the transverse score lines into a number of sections. The transverse score lines 25 and 26 are divided into sections 25A and 26A between side edge 23 and longitudinal line 27, sections 25B and 26B between longitudinal lines 27 and 29, sections 25C and 26C between longitudinal lines 29 and 30, sections 25D and 26D between longitudinal lines 30 and 28 and sections 25E and 26E between longitudinal line 28 and longitudinal edge 24.

The longitudinal lines divide the blank into a number of sections numbered 31 through 35. These sections in turn are divided by the transverse score lines into a central area 31A–35A and side areas 31B–35B and 31C–35C.

The same score lines and the same relationships will also be found in the blank shown in FIG. 2. FIG. 2 also illustrates a pair of optional longitudinal lines 37 and 38 which allow other sized containers to be formed. These longitudinal lines are spaced inwardly of the adjacent score line in the second pair of score lines 29' and 30' a distance equal to one-half the first dimension A. Longitudinal line 37 is spaced a distance equal to one-half the first dimension A from longitudinal line 29' and longitudinal line 38 is spaced a distance equal to one-half the first dimension A from longitudinal line 30'. The lines 37 and 38 are spaced a distance A from each other, and each is spaced a distance equal to one-half of dimension A from center line 36. These longitudinal lines are also divided by the transverse score lines 25' and 26' into a central score line section 37A and 38A, and outer perforated sections 37B and 38B, and 37C and 38C.

Again the longitudinal lines 37 and 38 divide the score lines 25' and 26' into a number of additional sections. These are sections 25F and 26F between longitudinal lines 29' and 37, sections 25G and 26G between longitudinal lines 37 and 38 and sections 25H and 26H between longitudinal lines 38 and 30'. The longitudinal lines also divide the blank into sections 39 between lines 29' and 37, 40 between lines 37 and 38 and 41 between lines 38 and 30'; and the transverse score lines 25' and 26' divide each of these sections into central areas 39A, 40A and 41A and side areas 39B, 40B and 41B and 39C, 40C and 41C.

It should be understood that the first dimension A or A' is a nominal distance and will vary depending upon the placement of the dimension on the blank, the size of flute and whether the blank is for the top or bottom container. For example, a nominal dimension A of 5" in a blank having a B flute will, in the blank 20, be 5 3/16" between the side edges 23 and 24 and the adjacent longitudinal lines 27 and 28, and be 5 5/16" between longitudinal lines 27 and 29 and longitudinal lines 30 and 28. The dimension 2A between lines 29 and 30 will be 10 3/8". The first dimension A between transverse score lines 25 and 26 and their adjacent transverse edges 21 and 22 would be $5\frac{1}{8}$". This will allow the dimension in the finished container to be 5" and takes into account the effect of the flute size and the location of the score line.

A nominal dimension will also be different if the blank is for the top or the bottom container. The same 5" nominal dimensions in blank 20' for the bottom container would be 5 1/6" between score lines 27' and its adjacent side 23' and score line 28' and its adjacent side 24', and $5\frac{1}{8}$" between lines 27' and 29' and lines 30' and 28'. The dimension 2A' would be $10\frac{1}{8}$". The dimension A' between score lines 37 and 38 would be $5\frac{1}{8}$" and the dimension A/2 between lines 29' and 37 and lines 38 and 30' would be $2\frac{1}{2}$". The distance A' between the transverse score lines 25' and 26' and their adjacent transverse edges 21' and 22' would be 5".

Again the dimension B may be any arbitrary number. For example, if the nominal dimension B was 13", the distance between score lines 25 and 26 in FIG. 1 would be $13\frac{5}{8}$" and between score lines 25' and 26' in FIG. 2 would be $13\frac{1}{4}$".

The other figures in the case illustrate how these blanks may be folded into various sized containers.

FIGS. 3 through 6 illustrate the formation of the container which has a depth of dimension A, a width of dimension $1\frac{1}{2}$A and length of dimension B. The longitudinal lines that would be used for this construction are 27, 28, and optional lines 37 and 38. The perforations 28B' and 28C', 38B and 38C, 37B and 37C and 27B' and 27C' would be used to form end flaps and end panels for the container. Areas 32A' and 39A would form the bottom of the container. Area 31A' would form the front wall of the container and area 40A would form the rear wall of the container. The front and rear walls would be folded up around score lines 27A' and 37A respectively. End flaps 40B and 40C would be folded inwardly around score lines 25G and 26G, and 31B' and 31C' folded inwardly around score lines 25A' and 26A'. Flaps 40B, 40C and 31B' and 31C' are the inner end flaps. The outer end panels for the bottom of the container bottom are formed by areas 32B' and 39B, and 32C' and 39C. These would be folded upwardly around their respective score lines and fastened to the inner end panels. Throughout the specification, fastening may be by stapling, taping or gluing.

The cover of the container is formed by areas 41A and 34A'. The cover is folded downwardly around score line 38A and the cover front panel 35A' is folded around score line 28' until it is contiguous with front wall 31A'. The end flaps 35B' and 35C' are folded inwardly around their respective scorelines 25E' and 26E' until they are against the end panels 32B' and 32C'. The cover end panels defined by areas 34B' and 41B and 34C' and 41C are folded downwardly around their respective score lines to form the outer end panels of the container. The cover end panels are fastened to the cover end flaps. The cover front panel is fastened to the lower container, usually by taping.

Figures 7, 8:
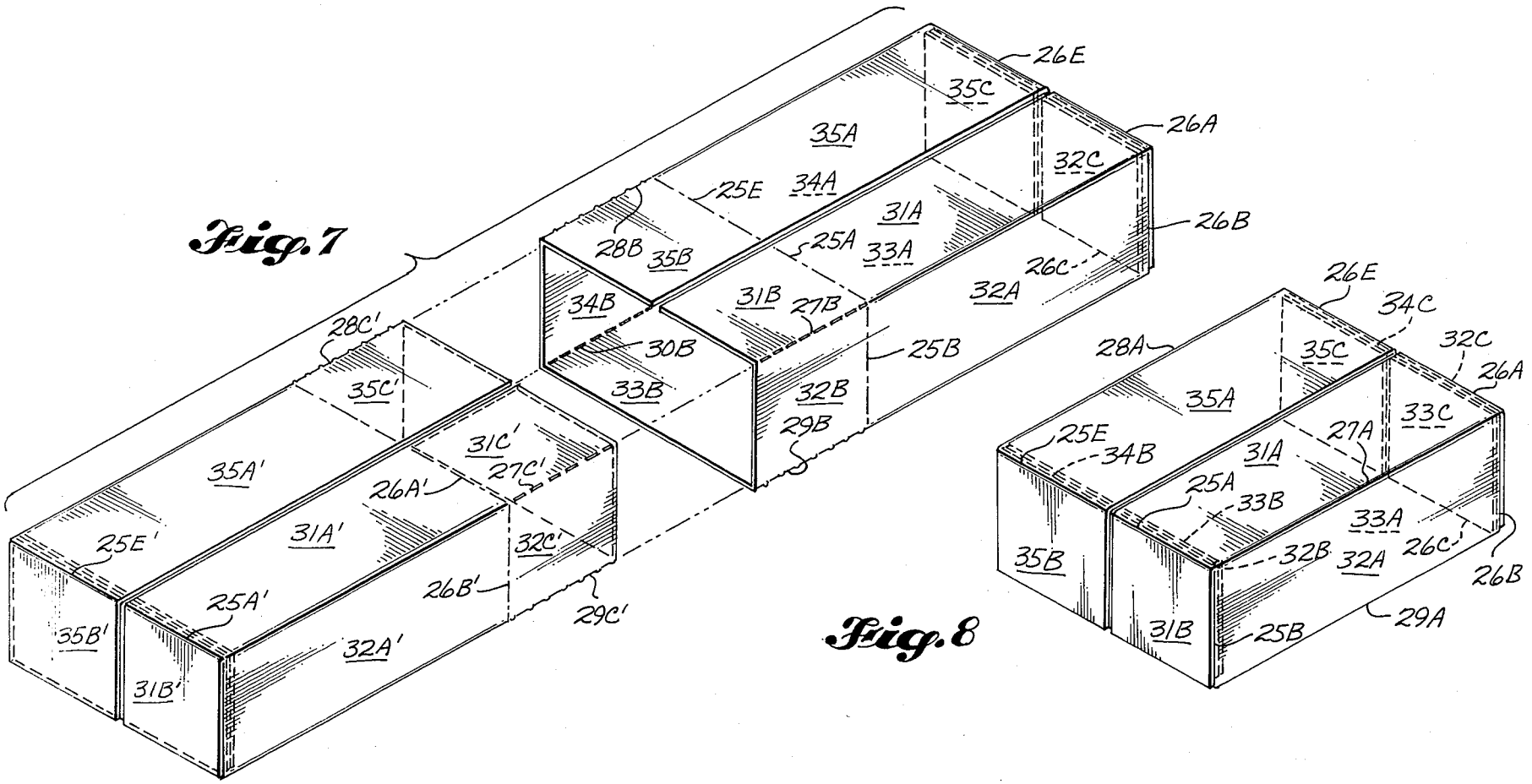

FIG. 7 discloses a two-piece telescoping container which has a depth A, a width 2A and a length A+B.

Both the top and bottom blanks are folded around lines 27, 29, 30 and 28 to form tubes having a cross-sectional dimension A by 2A. The perforations 27B', 29B', 30B' and 28B' on the lower container, and the perforations 27C, 29C, 30C, and 28C on the upper container are used to form end flaps and end panels. These end flaps and panels are folded inwardly and fastened to form the two container sections shown in FIG. 7. These sections are telescoped together.

FIG. 8 shows a container having a depth A, a width 2A and a length B. It may be formed from either blank 20 or 20'. It is formed in the same manner as either of the telescoping sections in FIG. 7. In this construction, however, the perforations at both ends of longitudinal lines 27, 29, 30 and 28 are used to form end flaps and panels on both ends of the container.

In both the containers in FIG. 7 and FIG. 8, the order of folding the end flaps is immaterial. The order shown in FIG. 8 is: first, the flaps 32B and 34B on one end and 32C and 34C on the other end; second, the panels 33B and 33C; and third, the flaps 31B and 35B on the first end, and 31C and 35C on the other end. This same order is also shown in FIG. 7.

Figure 9:
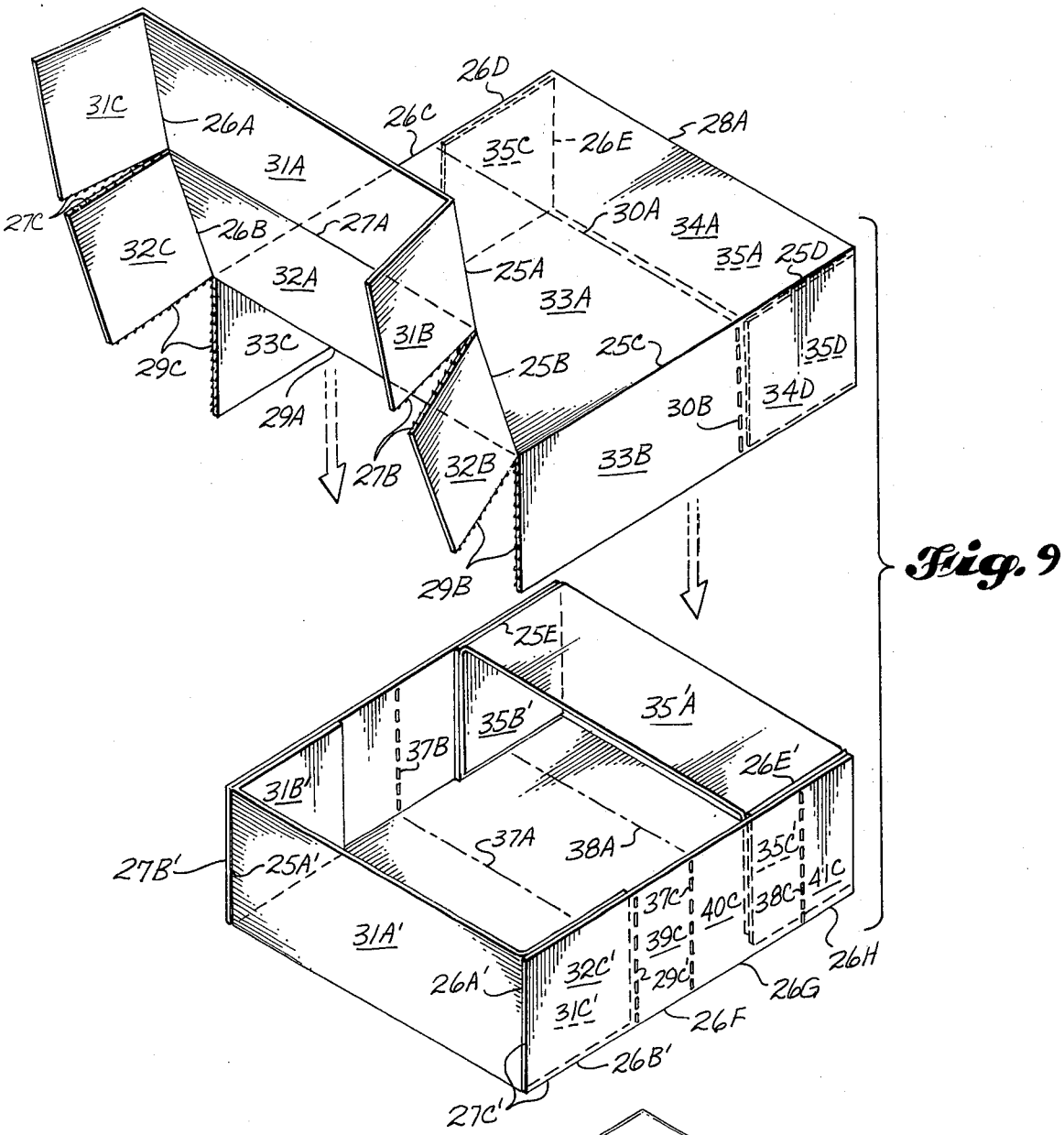
Figure 10:
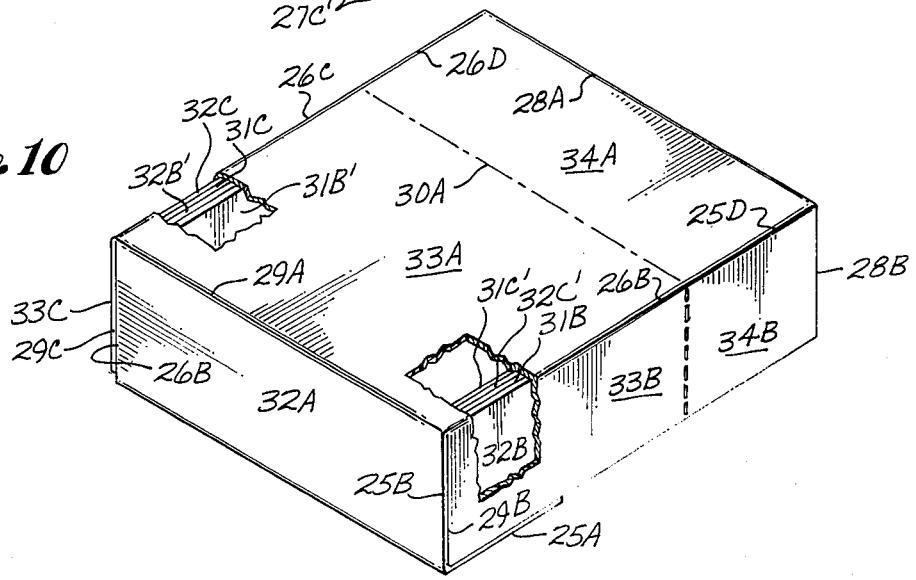

FIGS. 9 and 10 illustrate the method of forming a container having a depth A, a length 3A and a width B.

The bottom of the container is formed from blank 20'. In this blank the perforations along lines 27', 30' and 28' are used. Areas 32A', 39A, 40A and 41A form the bottom of the container; area 31A' forms the front wall of the container; and area 34A' forms the back wall of the container. The front and back walls are bent upwardly around their score lines 27A' and 30A'. The side flaps 31B', 31C', 34B' and 34C' are bent inwardly around their respective score lines 25A', 26A', 25D' and 26D'. In this construction the side panels are formed by areas 32B', 39B, 40B and 41B on one side and 32C', 39C, 40C and 41C on the other side. The side panels are bent up around score lines 25' and 26' and fastened to the end flaps 31B' and 31C', and 34B' and 34C'. Flaps 35B' and 35C' are bent inwardly around their score lines 25A' and 26A' and flap 35A' is bent downwardly around score line 28A' with flaps 35B' and 35C' extending inwardly of flaps 34B' and 34C'.

The container cover is placed over the bottom of the container. The container cover is formed around lines 27, 29 and 28. The perforations along each of these lines are used to form side flaps 33B, 34B, 33C and 34C. The upper face is formed by areas 33A and 34A, the back panel by area 35A, and the front panel by area 32A. The back panel 35A is bent downwardly around score lines 28A and the flaps 35B and 35C are bent inwardly around their respective score lines 25E and 26E. The upper side panels, defined by areas 33B and 34B, and 33C and 34C, are bent downwardly around score lines 25 and 26, and the areas 34B and 34C are fastened to flaps 35B and 35C respectively.

The container cover is placed over the bottom of the container and the flaps 31C and 32C, and 31B and 32B are bent inwardly around their respective score lines 26 and 25. The front panel 32A is bent downwardly around its score line 29A and the flaps 32B and 32C are slid inwardly between the upper side panels 33B and 33C and the lower side panels 31C' and 31B', respectively. Panel 31A is bent around its scoreline 27A to rest against the bottom of the container and the flaps 31B and 31C slid between the upper side panels and the flaps 32B and C. The upper and lower container sections are fastened together.

Figures 11, 12:
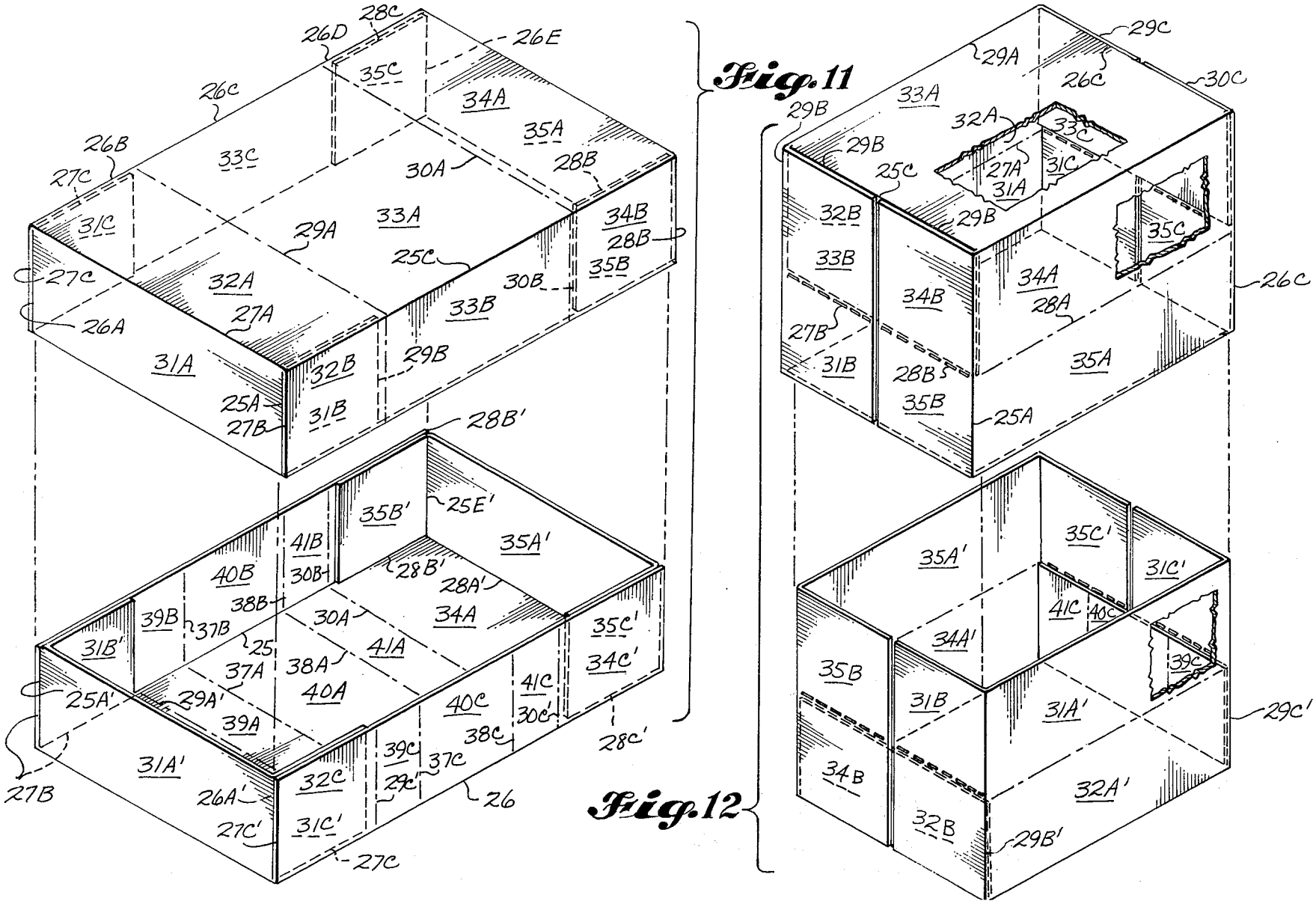

FIG. 11 illustrates a container having a depth A, a width B and a length 4A. Longitudinal lines 27 and 28 on the upper blank 20, which forms the cover of the container, and 27' and 28' in the lower blank 20', which forms the container, are used to form the container. The perforations on these lines are used to form side panels and end flaps. In blank 20, panels 31A and 35A are bent around their respective score lines, and the end flaps 31B, 31C, 35B and 35C are fastened to the side panels. The side panels on the cover are formed by sections 32B, 33B and 34B on one side and 32C, 33C and 34C on the other side. The container is formed by folding the panels 31A' and 35A' around their respective score lines, folding the end flaps 31B', 31C', 35B' and 35C' inwardly and folding the side panels upwardly around their score lines and fastening the end flaps to the side panels. The side walls are formed by areas 32B', 39B, 40B, 41B and 34B' on one side and by areas 32C', 39C, 40C, 41C and 34C' on the other side. The two sections are telescoped together.

FIG. 12 shows the formation of a container having a length B, a depth 2A and a width 2A. In the cover, the perforations along lines 29 and 30 are used and in the lower container the perforations along lines 29' and 30' are used. In the cover, the cover panel is formed by area 33A; the side panels by areas 31A and 32A, and 34A and 35A; the inner end flaps by areas 33B and 33C; and the outer end panels by areas 31B and 32B, 34B and 35B, 31C and 32C, and 34C and 35C. The side panels and inner end flaps are bent downwardly around their score lines, and the outer end panels bent inwardly around their score lines and fastened to the end flaps. The bottom of the container is formed in the same manner and the two sections are telescoped together.

Figure 13:
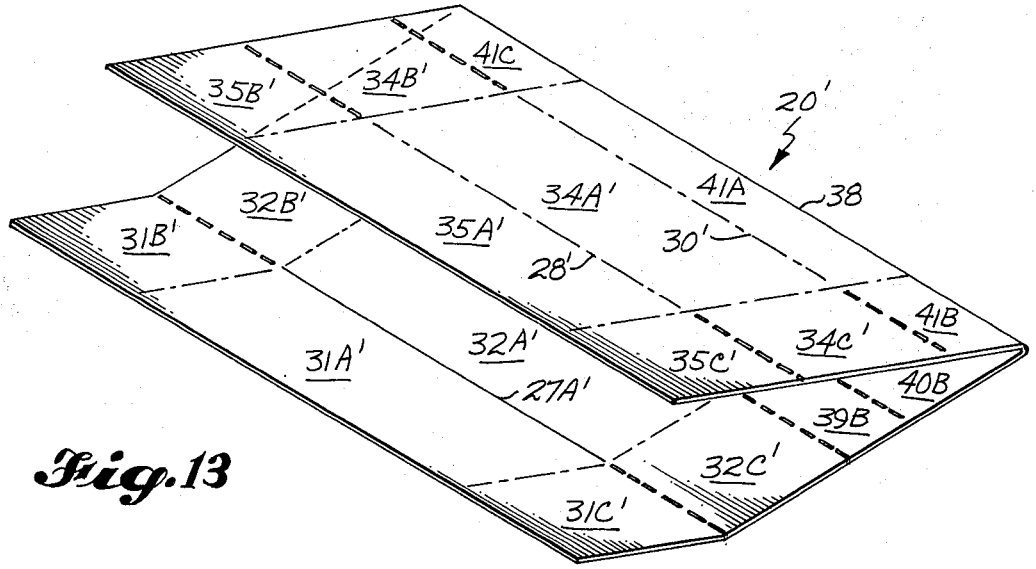
Figure 14:
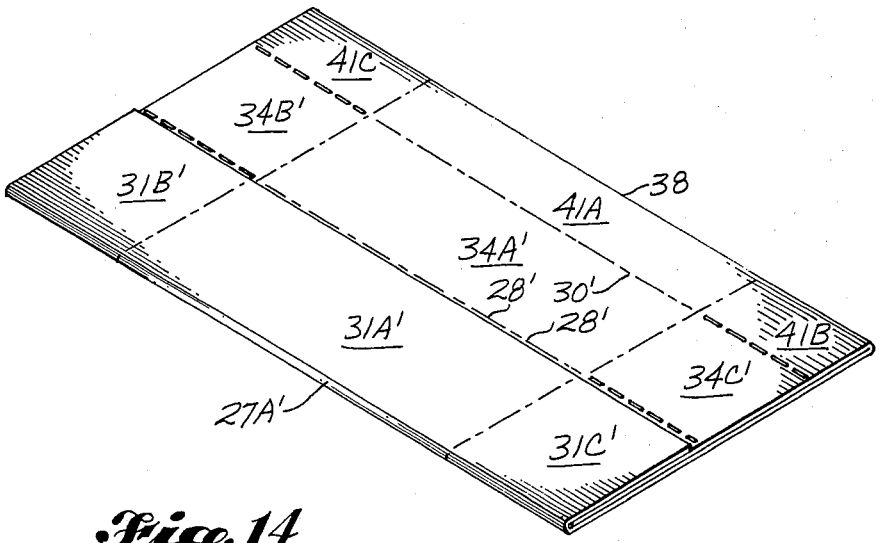

The blanks may be formed into a number of folder sizes depending on which score lines are used. FIGS. 13–14 illustrate this. In the folder shown, the blank is bent around score lines 38 and 27'.

In the claims the term "first dimension" refers to the nominal dimension and not to the actual dimension.

In each of the telescoping containers, a minimum dimension in the telescoping directions is given. The dimension can be greater if the container is not fully telescoped.

What is claimed is:

1. A blank for forming a number of various sized containers comprising a rectangular sheet of material having a pair of parallel transverse edges and a pair of parallel longitudinal edges;

said blank having a pair of transverse score lines parallel to said transverse edges, each of said score lines being spaced from its adjacent transverse edge a first distance;

said blank having a first pair of longitudinal score lines parallel to said longitudinal edges and extending between said transverse score lines, each of said longitudinal score lines being spaced from its adjacent longitudinal edge said first distance;

said blank having a second pair of longitudinal score lines positioned inwardly of said first pair of longitudinal score lines, parallel to said first pair of longitudinal score lines and extending between said transverse score lines, each of said second pair of longitudinal score lines being spaced from its adjacent longitudinal score line of said first pair of longitudinal score lines and said first distance and said second pair of longitudinal score lines being spaced from each other twice said first distance;

said blank having perforations extending between each of said transverse score lines and its adjacent transverse edge, said perforations being aligned with said longitudinal score lines.

2. The blank of claim 1 further comprising a third pair of longitudinal score lines positioned inwardly of said second pair of longitudinal score lines, parallel to said second pair of longitudinal score lines and extending between said transverse score lines, each of said third pair of longitudinal score lines being spaced from its adjacent longitudinal score line of said second pair of longitudinal score lines a distance equal to one-half of said first distance and being spaced from each other said first distance;

additional perforations in said blank extending between each of said transverse score lines and its adjacent transverse edge, said perforations being aligned with said third pair of longitudinal score lines.

* * * * *